US006654977B1

(12) United States Patent
Chin

(10) Patent No.: US 6,654,977 B1
(45) Date of Patent: Dec. 2, 2003

(54) SAFETY RAMP

(76) Inventor: Howard Chin, 7 Fl., No. 227, Sec. 3, Roosevelt Rd., Taipei (TW)

( * ) Notice: Subject to any disclaimer, the term of this patent is extended or adjusted under 35 U.S.C. 154(b) by 0 days.

(21) Appl. No.: 10/234,096

(22) Filed: Sep. 5, 2002

(51) Int. Cl.[7] ..... A63G 21/00; A63C 19/00; E01D 1/00

(52) U.S. Cl. ..... 14/69.5; 472/88

(58) Field of Search ..... 472/89, 88, 90; 14/69.5, 71.1, 72.5; 104/275, 276, 277

(56) References Cited

U.S. PATENT DOCUMENTS 3,965,967 A * 6/1976 Jentzsch et al. ..... 104/275
4,067,258 A * 1/1978 Valeri ..... 104/275
5,095,822 A * 3/1992 Martin ..... 104/275
5,267,367 A * 12/1993 Wegmann, Jr. ..... 14/69.5
5,400,846 A * 3/1995 Bowman ..... 152/213 R
5,566,622 A * 10/1996 Ziaylek et al. ..... 104/275
5,777,266 A * 7/1998 Herman et al. ..... 174/68.1
6,067,681 A * 5/2000 Zeinstra et al. ..... 14/69.5
6,202,565 B1 * 3/2001 Henry ..... 104/275
6,481,036 B1 * 11/2002 Duvall ..... 14/69.5

* cited by examiner

*Primary Examiner*—Robert E. Pezzuto
*Assistant Examiner*—Alexandra K. Pechhold
(74) *Attorney, Agent, or Firm*—Fei-Fei Chao; Venable LLP

(57) ABSTRACT

A safety ramp includes a bridge having two sloped side faces, a top plain face formed between the two sloped side faces and dovetailed protrusions formed on each of the sloped side faces. Two sloped pieces each has a hypotenuse, a plain face immediately adjacent to the hypotenuse to correspond to the top plain face of the bridge and an inclined face immediately adjacent to the plain face relative to the hypotenuse to correspond to one of the sloped side faces of the bridge. The inclined face is provided with a first step and a second step and has dovetailed slots defined in a side face between the two steps to correspond to the dovetailed protrusions so that the dovetailed protrusions of the bridge are able to be received in the corresponding dovetailed slots of the two sloped pieces to combine the two sloped pieces.

1 Claim, 5 Drawing Sheets

SAFETY RAMP

BACKGROUND OF THE INVENTION

1. Field of the Invention

The present invention relates to a ramp, and more particularly to a safety ramp having two sloped ramp pieces and a bridge securely sandwiched between the two sloped ramps.

2. Description of Related Art

With reference to FIG. 5, a conventional ramp (4) is a single-pieced, substantially wedged shaped slope. The ramp (4) has a hypotenuse (41), a plain face (42) immediately adjacent to the hypotenuse (41) and a vertical drop (43) adjacent to the plain face (42) relative to the hypotenuse (41). When a user is riding a bicycle or rolling an in-line skate to jump over the ramp (4) by using the hypotenuse (41), the hypotenuse (41) will provide a jumping force to lift the user in the air, which provides a thrill to the user. Especially, if the angle of the hypotenuse (41) becomes higher, the greater thrill the user will receive. However, when pursuing the extreme limit;r, the impact on the ground that comes along with the jump often injures the user. Although, the user is required to wear helmet, elbow and knee pads and even gloves, the user still suffers from broken bones and bruise.

To overcome the shortcomings, the present invention tends to provide an improved safety ramp to mitigate and obviate the aforementioned problems.

SUMMARY OF THE INVENTION

The primary objective of the present invention is to provide an improved safety ramp that is able to not only provide the riding or rolling thrill when coming over the ramp, but also protect the user from injury.

Another objective of the present invention is to have a bridge sandwiched between two sloped pieces so that the user is able to use the bridge as a cushion to avoid sudden impact.

Still another objective of the present invention is that the bridge has an arcuate bottom face so that the structural integrity is reinforced.

In order to accomplish the foregoing objective, the safety ramp of the present invention has two sloped pieces each having a hypotenuse, a plain face immediately adjacent to the hypotenuse and an inclined face immediately adjacent to the plain face relative to the hypotenuse and provided with two steps and dovetailed slots defined in a side face between the two steps. A bridge is provided between the two sloped pieces and has an arcuate bottom face and two sloped side faces corresponding to the inclined faces of the respective sloped piece. Each sloped side face of the bridge has dovetailed protrusions formed to correspond to the dovetailed slots of the respective sloped piece so that the bridge is able to detachably connect the two sloped pieces together.

Other objects, advantages and novel features of the invention will become more apparent from the following detailed description when taken in conjunction with the accompanying drawings.

DETAILED DESCRIPTION OF THE PREFERRED EMBODIMENT

Figure 1:
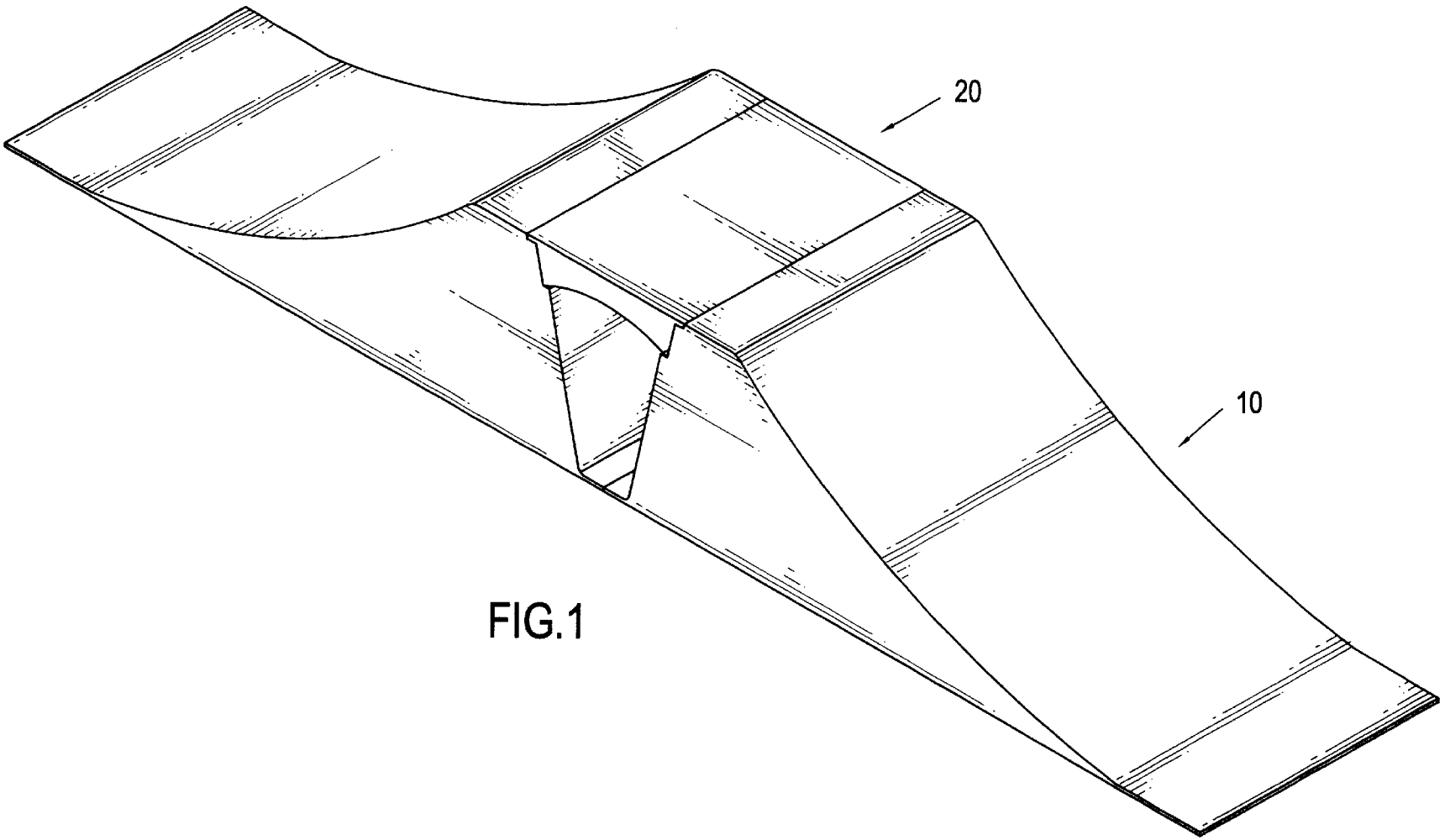
FIG. 1 is a perspective view of the safety ramp of the present invention.
Figure 2:
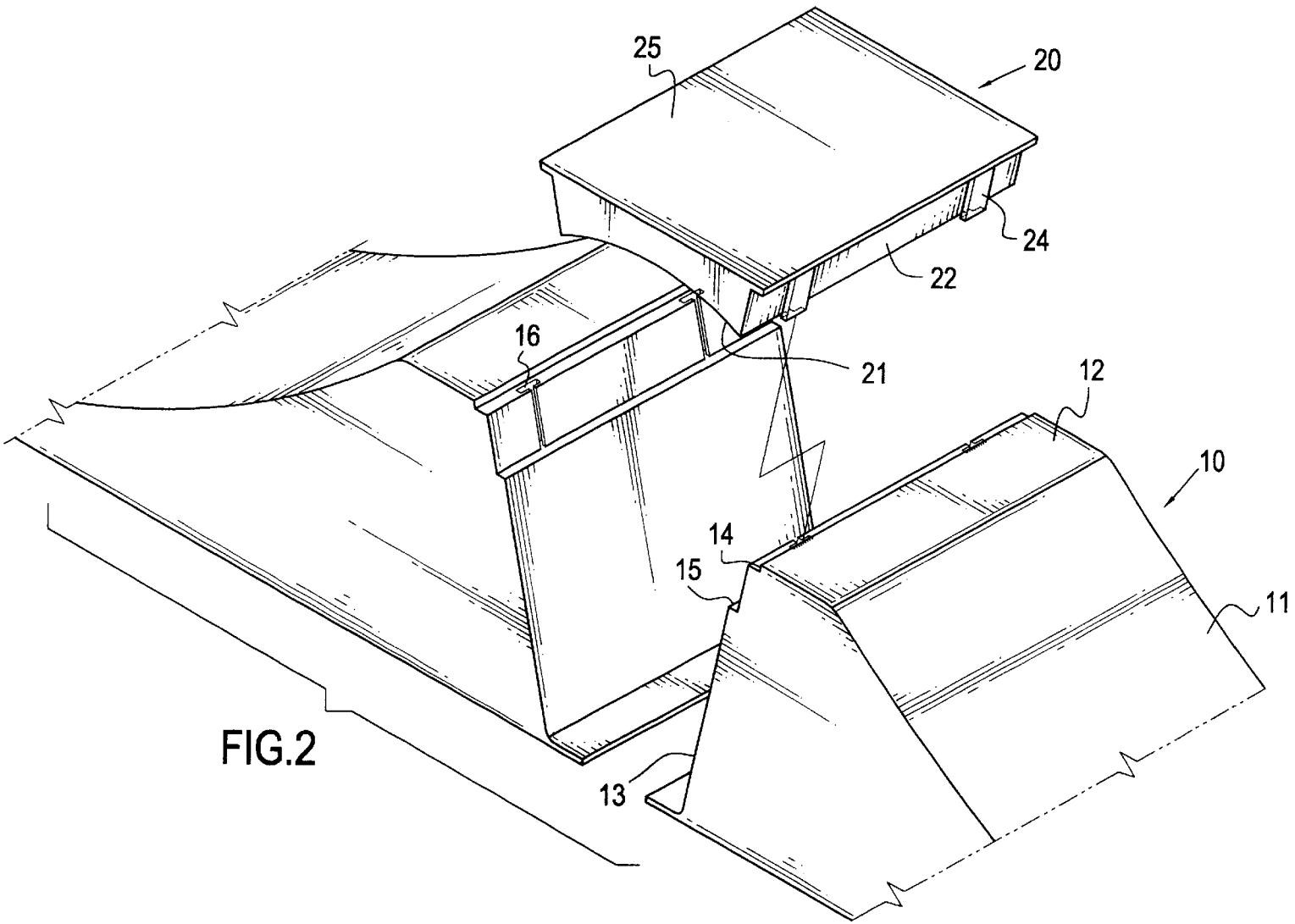
FIG. 2 is an exploded perspective view of the parts of the safety ramp in FIG. 1.

With reference to FIGS. 1 and 2, the safety ramp in accordance with the present invention has two sloped pieces (10) and a bridge (20).

Each sloped piece (10) has a hypotenuse (11), a plain face (12) immediately adjacent to the hypotenuse (11) and an inclined face (13) immediately adjacent to the plain face (12) relative to the hypotenuse (11) and provided with two steps, a first step and a second step, (14,15) and dovetailed slots (16) defined in a side face between the two steps (14,15).

The bridge (20) is provided between the two sloped pieces (10) and has an arcuate bottom face (21) and two sloped side faces (22) corresponding to the inclined faces (13) of the respective sloped piece (10). Each sloped side face (22) of the bridge (20) has dovetailed protrusions (24) formed to correspond to the dovetailed slots (16) of the respective sloped piece (10) so that the bridge is able to detachably connect the two sloped pieces (10) together. A top plain face (25) is formed relative to the arcuate bottom face (21) and peripheral side faces of the top plain faces (25) correspond to the first step (14) of the respective sloped piece (10). Meantime, peripheral edges of the arcuate bottom face (21) correspond to the second step (15) of the respective sloped piece (10).

Figure 3:
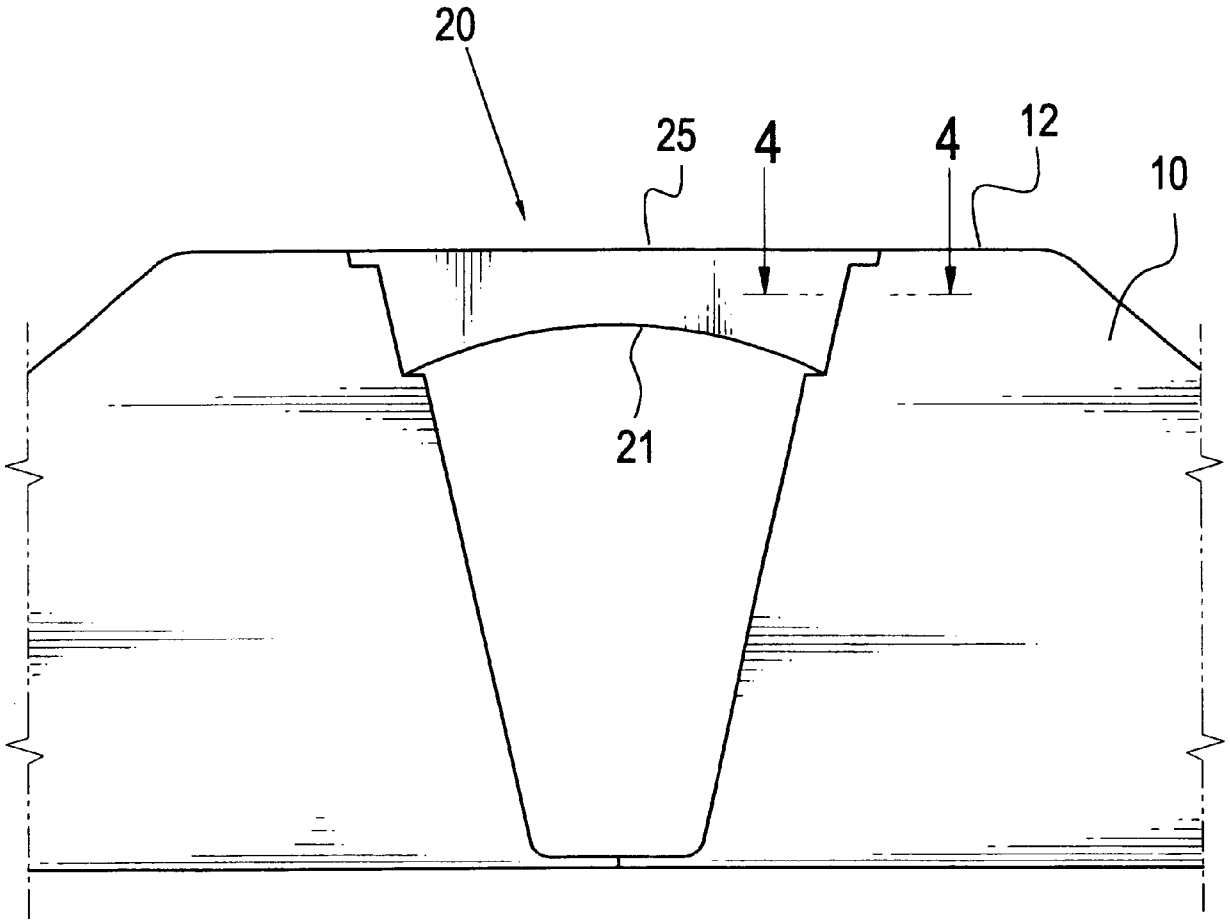
FIG. 3 is a side plan view of the assembled safety ramp in FIG. 1.
Figure 4:
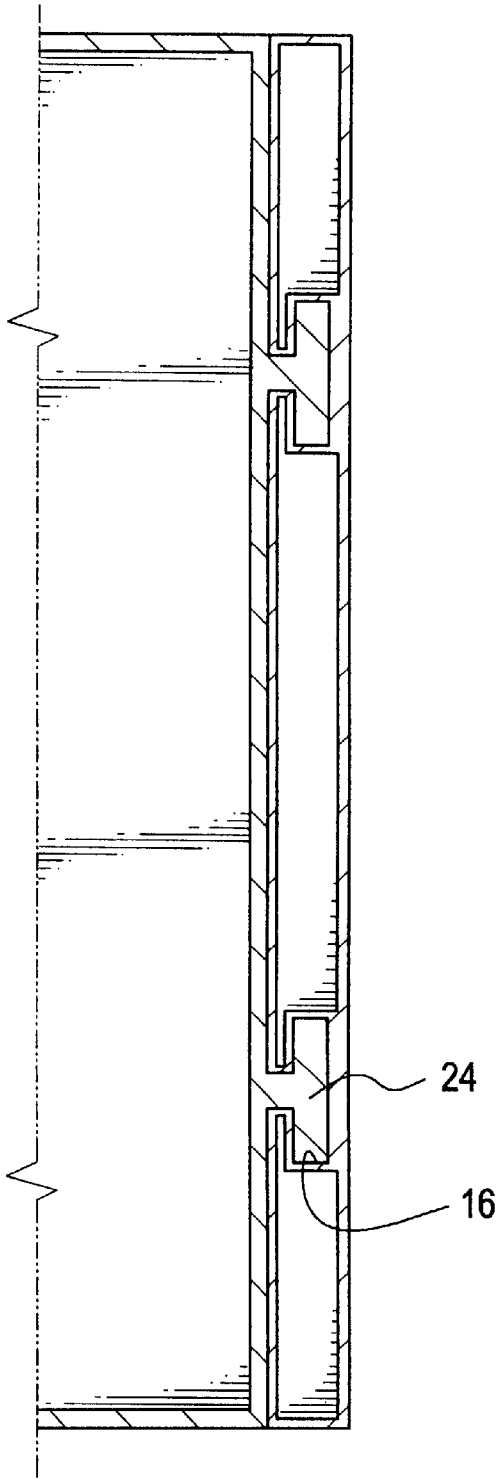
FIG. 4 is a cross sectional view of the engagement between the inclined face and the sloped face.
Figure 5:
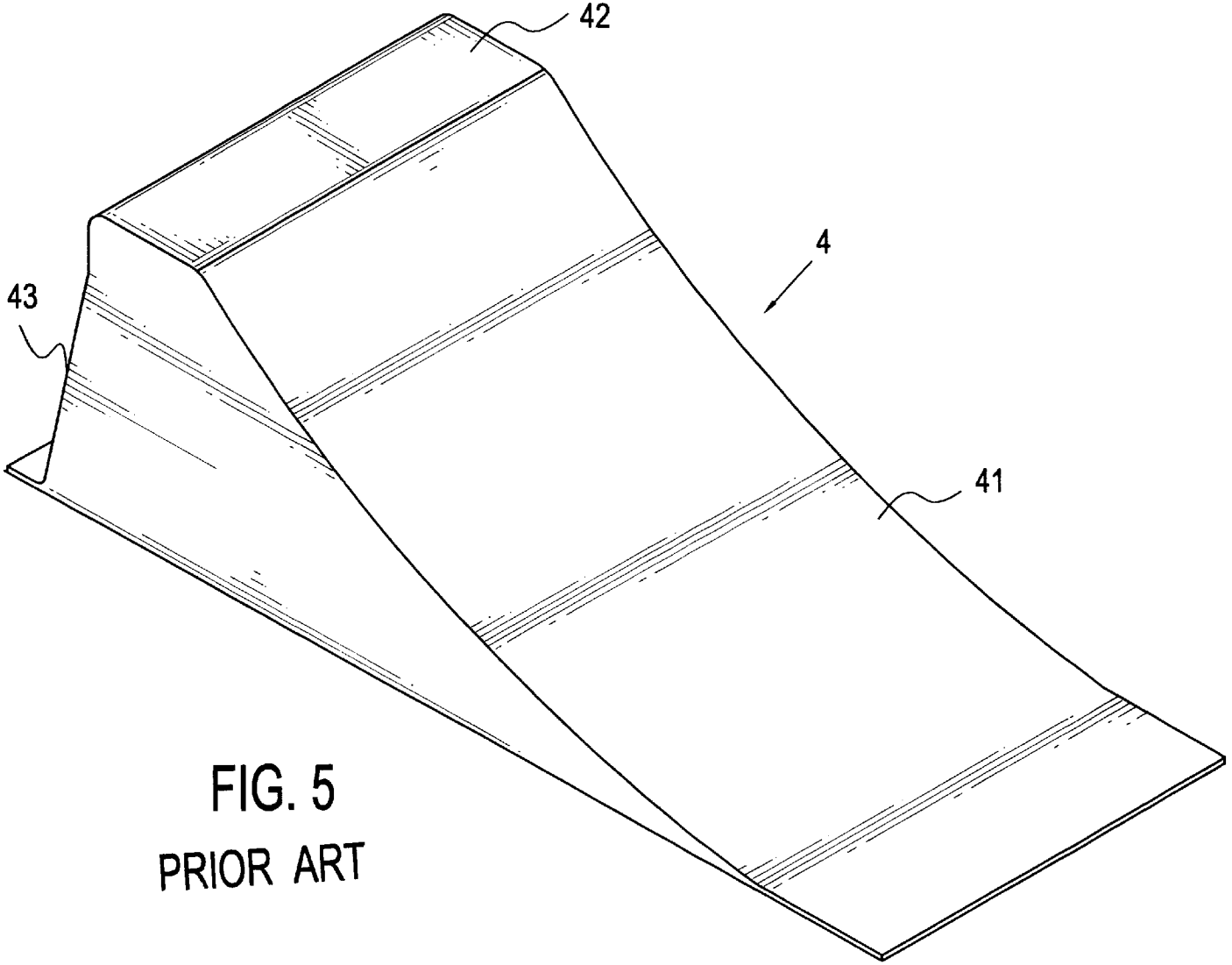
FIG. 5 PRIOR ART
FIG. 5 is a perspective view of a conventional ramp.

With reference to FIGS. 3 and 4, when the safety ramp of the present invention is assembled, the dovetailed protrusions (24) of the bridge (20) are inserted into the corresponding dovetailed slots (16) of each of the sloped pieces (10). Peripheral side faces of the so that the two sloped pieces (10) are combined. After the combination of the two sloped pieces (10) and the bridge (20), it is noted that the top plain face (25) is flush with the plain face (12) of each sloped piece (10) by resting the peripheral side faces of the top plain face (25) in the first step (14) and the peripheral edge of the arcuate bottom face (16) resting in the second step (15).

It is noted that the arcuate bottom face (21) of the bridge (20) reinforce the structural integrity of the bridge (20) and the bridge (20) is able to have a large load impacted on a top plain face of the bridge (20).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A safety ramp comprising:

a bridge having two sloped side faces, a top plain face formed between the two sloped side faces and dovetailed protrusions formed on each of the sloped side faces, two sloped pieces each having a hypotenuse, a plain face immediately adjacent to the hypotenuse to correspond to the top plain face of the bridge and an inclined face immediately adjacent to the plain face relative to the hypotenuse to correspond to one of the sloped side faces of the bridge, the inclined face being provided with a first step and a second step and dovetailed slots defined in a side face between the two steps to correspond to the dovetailed protrusions so that the dovetailed protrusions of the bridge are able to be received in the corresponding dovetailed slots of the two sloped pieces to combine the two sloped pieces, wherein the bridge has an arcuate bottom face formed relative to the top plain face and sandwiched between the two sloped side faces to reinforce structural integrity of the bridge, wherein peripheral side faces of the top plain face of the bridge rest on the first step and peripheral edge of the arcuate bottom face rest on the second step so that the top plain face is flush with the plain faces of each of the sloped pieces.

* * * * *